US011183036B2

(12) United States Patent
Dobbins et al.

(10) Patent No.: US 11,183,036 B2
(45) Date of Patent: Nov. 23, 2021

(54) METHOD AND APPARATUS FOR MOBILE CASH TRANSPORTATION

(71) Applicant: Ellenby Technologies, Inc., Woodbury Heights, NJ (US)

(72) Inventors: Aaron H. Dobbins, Cherry Hill, NJ (US); Bob M. Dobbins, Villanova, PA (US); Thomas Carullo, Marlton, NJ (US)

(73) Assignee: Ellenby Technologies, Inc., Woodbury Heights, NJ (US)

( * ) Notice: Subject to any disclaimer, the term of this patent is extended or adjusted under 35 U.S.C. 154(b) by 0 days.

(21) Appl. No.: 16/704,624

(22) Filed: Dec. 5, 2019

(65) Prior Publication Data

US 2020/0160675 A1 May 21, 2020

Related U.S. Application Data

(63) Continuation of application No. 15/707,345, filed on Sep. 18, 2017, now Pat. No. 10,522,010, which is a (Continued)

(51) Int. Cl.
*G08B 13/02* (2006.01)
*G07D 11/125* (2019.01)
(Continued)

(52) U.S. Cl.
CPC ..... *G08B 13/02* (2013.01); *E05G 1/005* (2013.01); *E05G 1/10* (2013.01); *G07D 11/125* (2019.01);
(Continued)

(58) Field of Classification Search
CPC .... G08B 13/02; G08B 13/06; G08B 13/1609; E05G 1/005; E05G 1/06; E05G 1/08;
(Continued)

(56) References Cited

U.S. PATENT DOCUMENTS 4,805,222 A 2/1989 Young et al.
5,404,583 A * 4/1995 Lalezari ..... H04B 1/3827 343/702
(Continued)

FOREIGN PATENT DOCUMENTS

GB 2341636 A * 3/2000 ..... E05G 1/005
GB 2540449 A * 1/2017 ..... B60P 3/03
(Continued)

OTHER PUBLICATIONS

Dobbins, A., et al., "Eye in the Sky Security System", May 2004, Page(s) http://people.ece.cornell.edu/land/courses/ece4760/FinalProjects/s2004/fci2/highleveldesign.html.

*Primary Examiner* — Quan-Zhen Wang
*Assistant Examiner* — Mancil Littlejohn, Jr.
(74) *Attorney, Agent, or Firm* — Ryan, Mason & Lewis, LLP

(57) ABSTRACT

A device designed to validate and transport paper currency in a protected fashion. While being transported, the device monitors for tampering or break-in attempts and subsequently generates warning notifications, or sounds an alarm depending on configuration and the type of tampering detected. The transport case provides end-to-end cash accountability from a location where a bill is inserted into the case, to the bank or cash destination, where the transport case is delivered. Additionally, a docking station accessory is described in which the transport case can be securely fixed while at a point of sale.

19 Claims, 8 Drawing Sheets

Related U.S. Application Data continuation of application No. 14/302,555, filed on Jun. 12, 2014, now Pat. No. 9,799,179.

(60) Provisional application No. 61/834,120, filed on Jun. 12, 2013.

(51) Int. Cl.

| | |
|---|---|
| ***E05G 1/10*** | (2006.01) |
| ***E05G 1/00*** | (2006.01) |
| ***G08B 13/06*** | (2006.01) |
| ***A45C 1/00*** | (2006.01) |

(52) U.S. Cl.

CPC ..... *A45C 2001/006* (2013.01); *G08B 13/06* (2013.01)

(58) Field of Classification Search

CPC .. E05G 1/10; E05G 1/14; E05G 1/024; G07F 9/06; G07D 11/0009; G07D 11/0042; A45C 2001/006; A45C 2001/067; A45C 2001/086; A45C 1/12

USPC ..... 340/568.7

See application file for complete search history.

(56) References Cited

U.S. PATENT DOCUMENTS

| | | | | |
|---|---|---|---|---|
| 5,598,793 | A | 2/1997 | Lopez, Jr. | |
| 5,615,625 | A * | 4/1997 | Cassidy | E05G 1/005 109/45 |
| 5,616,625 | A | 4/1997 | Hung et al. | |
| 5,952,920 | A | 9/1999 | Braddick | |
| 6,564,726 | B1 | 5/2003 | Lindskog | |
| 7,100,520 | B2 | 9/2006 | Abe et al. | |
| 7,281,477 | B2 | 10/2007 | Dyson et al. | |
| 7,516,832 | B2 | 4/2009 | Dobbins | |
| 7,707,950 | B2 | 5/2010 | Villiger | |
| 7,969,304 | B2 * | 6/2011 | Berland | B65D 33/1675 340/568.1 |
| 8,054,183 | B2 | 11/2011 | Villiger | |
| 8,134,464 | B2 | 3/2012 | Lynch | |
| 8,332,932 | B2 | 12/2012 | Kellas-Dicks et al. | |
| 9,799,179 | B2 | 10/2017 | Dobbins et al. | |
| 2003/0160701 | A1 | 8/2003 | Nakamura et al. | |
| 2004/0119588 | A1 | 6/2004 | Marks | |
| 2004/0163913 | A1 | 8/2004 | Tschudy | |
| 2006/0220850 | A1 * | 10/2006 | Bowser | G08B 25/01 340/568.1 |
| 2006/0249531 | A1 | 11/2006 | Litchfield | |
| 2007/0132583 | A1 | 6/2007 | Sweeney, II | |
| 2007/0152839 | A1 | 7/2007 | Dalzell et al. | |
| 2007/0250920 | A1 * | 10/2007 | Lindsay | G07F 7/1025 726/7 |
| 2008/0136587 | A1 * | 6/2008 | Orr | G08C 19/00 340/5.31 |
| 2009/0235847 | A1 | 9/2009 | Villiger | |
| 2010/0001859 | A1 * | 1/2010 | Sharma | G08B 25/008 340/545.1 |
| 2010/0168903 | A1 * | 7/2010 | Aas | G07D 11/125 700/214 |
| 2010/0188287 | A1 * | 7/2010 | Madsen | G01S 19/16 342/357.54 |
| 2011/0155026 | A1 | 6/2011 | Villiger | |
| 2012/0146803 | A1 | 6/2012 | Gear et al. | |
| 2012/0235912 | A1 | 9/2012 | Laubach | |
| 2012/0279875 | A1 * | 11/2012 | Simpson | A45C 13/10 206/1.5 |
| 2013/0024952 | A1 | 1/2013 | Sivertsen | |
| 2014/0368345 | A1 | 12/2014 | Dobbins et al. | |
| 2018/0089968 | A1 | 3/2018 | Dobbins et al. | |

FOREIGN PATENT DOCUMENTS

| | | |
|---|---|---|
| GB | 2540449 A | 1/2017 |
| JP | H0498387 A | 3/1992 |

* cited by examiner

FIG. 2
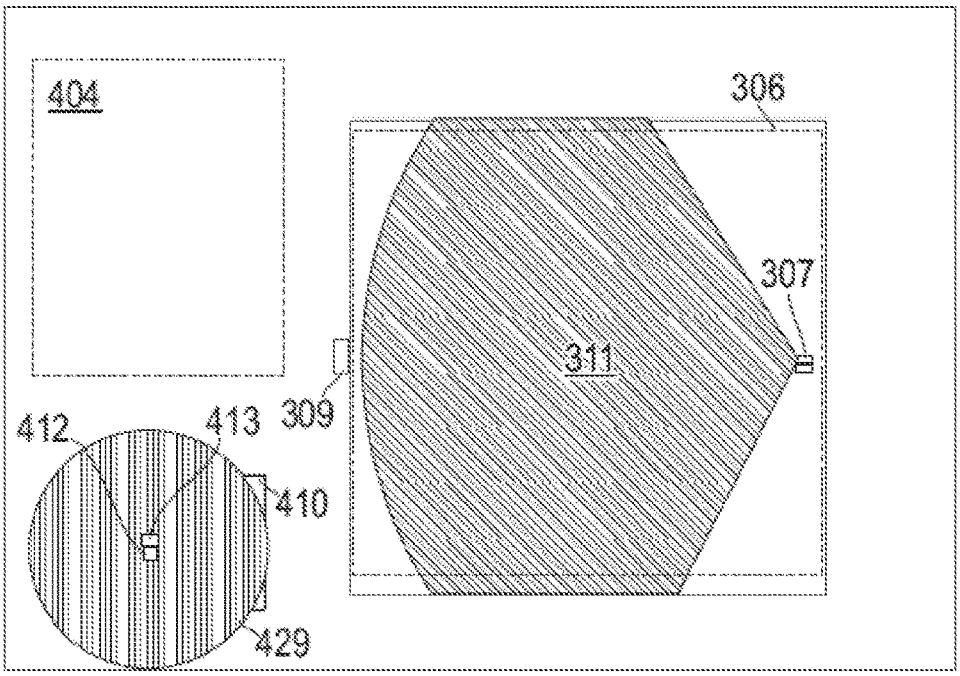
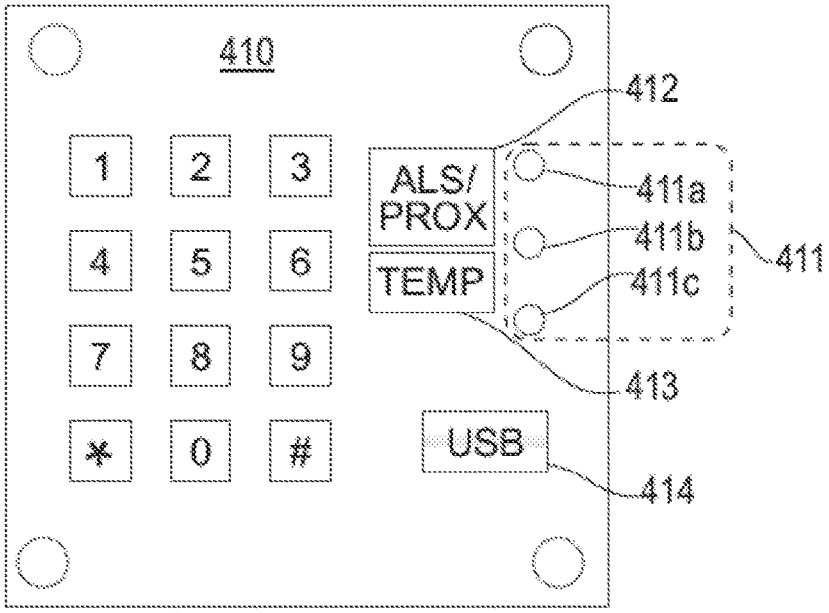
FIG. 3

METHOD AND APPARATUS FOR MOBILE CASH TRANSPORTATION

The present application is a continuation of U.S. patent application Ser. No. 15/707,345 filed Sep. 18, 2017 which is a continuation of U.S. patent application Ser. No. 14/302,555 filed Jun. 12, 2014, published as U.S. Patent Application Publication No. 2014/0368345 A1 entitled "Method and Apparatus for Mobile Cash Transportation" and now issued as U.S. Pat. No. 9,799,179, which claims the benefit of U.S. Provisional Application Ser. No. 61/834,120 filed Jun. 12, 2013 entitled "Method and Apparatus for Mobile Cash Transportation", all of which are incorporated by reference herein in their respective entireties. The present application is related to U.S. application Ser. No. 14/302,598 filed Jun. 12, 2014 and issued as U.S. Pat. No. 9,406,208 entitled "Mobile Cash Transport System with Tampering Triggered Ink Deployment", which claims the benefit of U.S. Provisional Patent Application Ser. No. 61/834,148 filed Jun. 12, 2013 entitled "Mobile Cash Transport System with Tampering Triggered Ink Deployment"; and is also related to U.S. patent application Ser. No. 14/328,784 filed Jul. 11, 2014 and issued as U.S. Pat. No. 9,113,518 entitled "Battery Powered Light Source for Compartment Illumination", which claims the benefit of U.S. Provisional Patent Application Ser. Nos. 61/875,205 and 61/845,095 filed Sep. 9, 2013 and Jul. 11, 2013, respectively, entitled "Battery Powered Light Source for Compartment Illumination", all of which are incorporated by reference herein in their respective entireties.

FIELD OF THE INVENTION

The present invention relates generally to improved methods and apparatus for mobile cash transportation, and more particularly to aspects of a cash transportation case with improved tamper detection and a bill validator managed by an internal control system.

BACKGROUND OF THE INVENTION

There are a number of electronic smart safe products on the market that can both electronically recognize currency deposited and securely store the deposited currency. An example of this technology is described in U.S. Pat. No. 7,516,832 which is assigned to the assignee of the current invention and is incorporated herein by reference in its entirety. This technology has the limitation of being a stationary container normally bolted in place. Additionally, this technology is designed to be heavy using thick gauge steel and reinforced for security. Frequently, to increase security when removing the collected currency from the electronic support safe, an armored car service is used.

When the added cost of using an armored car service is prohibitive, alternatives are available. Devices used to securely transport paper currency are offered in many forms and styles from sturdy metal cases to locked nylon zipper bags and simple bank deposit bags. In recent years, a number of more sophisticated cash carrying devices have been introduced that add indelible ink deployment mechanisms to devalue currency in the event of theft.

These transport systems typically require that the user first store currency in an intermediate location that is often less protected from theft such as the cash drawer of a point-of-sale (POS) system. While in the intermediate storage location, the cash is vulnerable to theft by an external threat, such as a robber or an internal threat, such as an employee.

Many existing systems use mechanical keys or a range of electronic key options, including radio frequency identification (RFID) tags, Dallas keys, or an optical communication link, to disarm the cash carrying devices to allow retrieval of the cash. These types of systems are vulnerable to key-theft. It is well known that biometric authentication methods can be much more effective in preventing unauthorized access, but such approaches tend to add significant cost as in the case of fingerprint scanners, palm print scanners, retinal scanners, or voice print analyzers. In U.S. Pat. No. 4,805,222, Young discloses an alternate method of biometric authentication through the analysis of an individual's typing patterns including the timing between characters and the pressure of each keystroke. By applying probability techniques, the natural typing cadence of particular users are compared against a database of pre-captured typing cadences to scan for a match. This technique involves the use of a large database containing typing pattern information for a variety of users and employs rigorous computer processing and analysis to validate the keystroke dynamics. The use of keyboard pressure sensing requires the use of specially design keypad interfaces with built-in pressure sensors.

Kellas-Dicks in U.S. Pat. No. 8,332,932 offers an alternative algorithm for analyzing keystroke dynamics based on not only dwell time between characters, but also through the analysis of derivatives and other mathematical products determined based on collected key press timing information. In both the approaches taken by Young and Kellas-Dicks, the objective is to provide authentication of a user based on their natural typing patterns. As a result, the data processing burden is substantial.

In the Eye in the Sky security system project described in, Eye in the Sky Security System Project—May 2004, Aaron Dobbins and Fran Ianacci, http://people.ece.cornell.edu/land/courses/ece4760/FinalProjects/s2004/fci2/high-leveldesign.html ("the Dobbins method"), a simpler keystroke dynamics authentication scheme is disclosed in which a user is prompted to come up with a unique keystroke pattern for their pass code. The user is given a blinking light emitting diode (LED) prompt to aid in both creating and recalling their unique timing sequence. In this manner, a deliberate keypad sequence can be much more easily authenticated with keystroke timing and character information alone.

SUMMARY OF INVENTION

One aspect of this invention seeks to protect cash from the moment a cash transaction occurs, until the moment that cash is deposited at its destination, while also providing verification of the validity of the cash or bank note placed into the transport case.

The present invention improves on the Dobbins method by monitoring both the durations of time between keystrokes, and the duration of the keystroke themselves, and provides an advantageous new training mode technique to aid or prompt users in generating their unique keystroke patterns.

Another aspect of the invention addresses a cash transportation case that combines ready portability with sophisticated tamper detection sensors and a bill validation system which is managed by an internal control circuit that is capable of fully protecting the cash in transit without the need for a link to external processors. Control circuitry, such as an on-board microcontroller, programmed microprocessor, field programmable gate array (FPGA), application specific integrated circuit (ASIC), or the like, or some combination thereof (collectively "controller"), can track money stored within the case, monitor tamper protection sensors, and communicate the information over one or more communication links including a wired or wireless connection to a computer, smart phone device, or web server for the purpose of providing a manager with a remote interface into the transport case.

The cash transportation case may suitably comprise a cash stronghold module, control circuitry, tamper detection sensors, a power source, and an outer case enclosure. The cash stronghold module further comprises a bill validator mechanism, a cash cassette, and a cash compartment door that provides access into the cash cassette. The control circuitry comprises a microcontroller, memory storage, one or more wireless transceivers, electrical interfaces to one or more sirens, tamper sensors, a keypad, LED indicators, and a battery charging port. With a battery supply and its ready portability, the cash transportation case of the invention finds ready applicability to environments, such as fairgrounds, ice cream and food trucks, and the like, where enhanced cash protection would be highly advantageous.

An objective of this invention is to implement novel tamper detection sensor methods advantageously suited for cash transport applications through the use of ambient light sensors to detect breaches in an internal cavity having an illumination below a predetermined level, such as a pitch black case interior space. The ambient light sensors are further complemented by the use of reflective infrared (IR) proximity sensors that are effective in recognizing the presence of nearby foreign objects such as probes, tools, or fingers located within a range up to 20 cm of the sensor elements. The reflective IR sensors are affixed to the cash stronghold module subassembly such that motion of the cash stronghold with respect to the outer case walls can also be detected.

Ambient light sensing elements are optimally suited to detect the presence of small amounts of visible light over a wide incidence angle but are not well suited in the event a case wall breach occurs in a dark room. Reflected IR proximity sensors can detect motion or objects over a comparably narrower incidence angle, but remain effective in any room lighting.

Another objective of the current invention is to use an orientation sensor such as a three-axis accelerometer to monitor the transport case orientation for signs of mishandling. The case can be preconfigured to only accept certain valid orientations. In the event the case is stolen, the thief may not be aware of the valid orientations, and if placed in an invalid orientation, the case may enter an alarm state in which audible sirens are activated, wireless alerts are issued, or both.

Another objective of the current invention is to monitor the state of a cash compartment door such that a sensor is utilized to detect the very start of a door opening operation. The door opening procedure requires a minimum duration of time to open the mechanical latch mechanism, which provides the necessary delay to ensure alarm sirens and wireless alerts can be sent out before the door is opened. The delay time is preferably on the order of several seconds and the latch mechanism may be in the form of a captured screw latch, preferably of the type offered by Southco.

Another objective of the current invention is to couple the above mentioned tamper detection sensors to a control circuit capable of interpreting sensor data, communicating the data to an external terminal device over a wireless link, and receiving inputs from that terminal device or a local keypad to change the operating state of the transport case. The external terminal can be in the form of a smart phone or tablet equipped with a compatible wireless radio, and is the preferred method of sending state change information to the case such as arm or disarm commands which are sent over an encrypted data link. Alternatively, arm and disarm commands can be entered into the local keypad in a novel manner that requires both a correct key press sequence along with the proper delays between key presses. A blinking LED is provided near the keypad to provide a metronome function that enables a user to consistently enter their code with proper delays. Alternatively, the appropriate key can be lit to prompt the user to press that key and then turned off to prompt the user to release the key for the proper duration before the next key is lit, and so on. Both the key press sequence and the delays between key presses are programmable such that they can be customized for each user. In this manner, if the case were stolen, a thief would need to know both the pin code and the proper timing between button presses to access the cash area. This approach alleviates the problem presented by users writing down their personal identification number (PIN) codes near or on a device, such as a computer, or the like, as well as the problem of scammers mounting a camera on an automated teller machine (ATM) or observing a user key in his or her code.

Another objective is to provide a mode in which a user can train the transport case with their own unique disarm pin code and key press pattern in which a blinking LED or buzzer is used to provide a metronome by which to calibrate press intervals. Once an arbitrary key press sequence is entered by a user in training mode, the user is prompted to re-enter the code with the same unique timing, but on second entry, the LED or buzzer will mirror when the button presses should occur as a guide. The process may be repeated until the user is comfortable with the selected sequence at which point, the guide LED or buzzer will be replaced once again with only a metronome indicator. This training mode can alternatively be used to teach a pre-assigned button press sequence to a user rather than allowing the user to select an arbitrary sequence.

Another objective is to poll the transport case carrier at randomized intervals while armed to provide authentication credentials to prove that a valid user is still in control of the transport case. Authentication is preferably performed by entering a unique pin code into the user's terminal device, such as a smart phone, biometric authentication through the use of a voice print, fingerprint or palm print scan. One simple approach is for the user to take a photo with a cell phone and transmit it to a central location for authentication. It is also possible to perform a biometric authentication on the terminal device and communicate the success or failure of the authentication to the transport case. Another authentication method may be a special tap sequence on the exterior of the case which is detected by vibration sensors interpreted by the control circuitry inside the transport case. The method of authentication in a presently preferred embodiment does not require the user to open the transport case. In the event the authentication test fails, the controller in the transport case can activate a siren, send out wireless notifications or a combination of the two. Alerts can also be issued to managers who wish to monitor their transport case remotely. These alerts may be issued over an RF link such as a cellular network by way of a modem located either in the transport case itself or on the terminal device.

Another objective of the current invention is to provide a cash transport case that contains an onboard database of security parameters, user names along with their access codes and permission levels, GPS coordinates of valid destinations or route waypoints, and identification numbers of wireless radio keyfobs or waypoint beacons. This on board database is modifiable through the use of a wireless connection to a terminal device or a data server. By containing all the above mentioned data within the transport case, the security of the case is maintained even in the event that external communication links are disabled. In a presently preferred implementation, only a single electrical port is needed to pass through the transport case outer wall for the purpose of connecting a battery charging power supply. This charging port may alternatively be eliminated if a wireless charging technology is employed, such as the one prescribed by the Qi consortium. In this manner, direct electrical access to the control circuitry is minimized resulting in fewer electrical connections to protect against electrical overstress in attempts to disable control circuitry.

Yet, another object of the current invention is to provide a transport case secure docking station that is capable of receiving one or more transport cases. The docking station can be securely fastened to the floor, walls, or fixtures located at the point of sale. When the case is docked, it is locked into the secured docking station by means of mechanical locks or electronic solenoid locks and cannot be removed until the locks are disengaged by way of mechanical key, combination entry, or electronic key methods. The docking station is a mechanism to prevent a snatch and grab theft of the transport case while at the point of sale. It may also function to provide a mechanism to recharge the batteries within the transport case.

A more complete understanding of the present invention, as well as further features and advantages of the invention, will be apparent from the following Detailed Description and the accompanying drawings.

BRIEF DESCRIPTION OF THE DRAWINGS

FIG. 2 shows an example configuration of tamper sensors in accordance with an embodiment of the present invention;

FIG. 3 is a diagram of a keypad suitably used in conjunction with the present invention;

DETAILED DESCRIPTION

Figure 1:
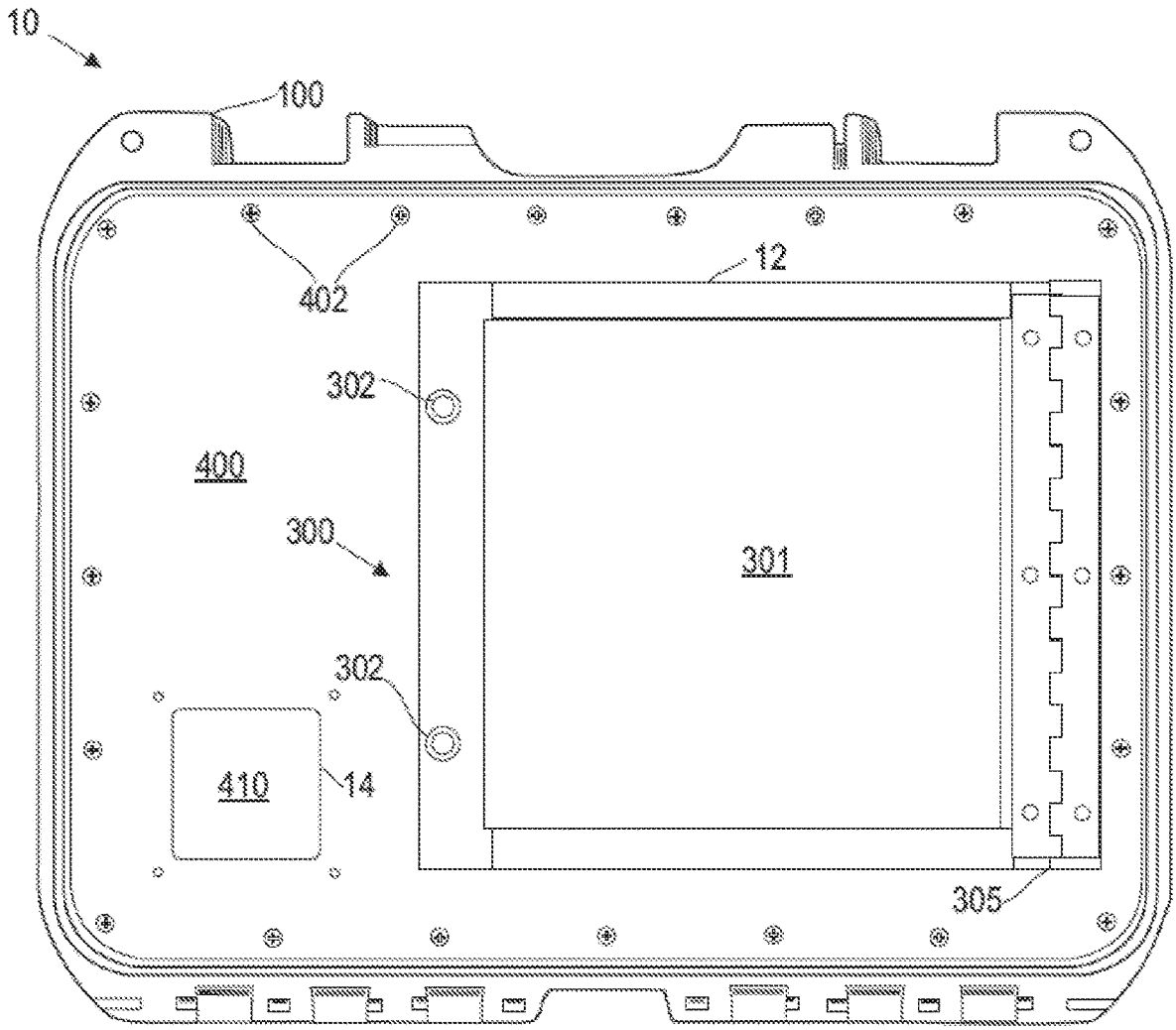
FIG. 1 shows an illustration of the interior of a transport case according to the present invention.

FIG. 1 depicts a rendering of a portable cash transport apparatus 10. The portable case transport apparatus 10 has a portable case formed by bottom shell 100 and top shell 101 (best seen in FIG. 11). These shells are preferably made of a durable plastic material that is largely transparent to radio frequency transmissions in the 2.4 GHz band. In FIG. 1, top shell 101 is removed for ease of illustration. Preferably, this portable case is light-tight and can maintain a water-tight seal when closed. The case has a handle 102 (FIG. 11), and a hinge 103, that connects the bottom shell 100 to the top shell 101. Case 10 is shown closed in a perspective view in FIG. 11.

A center partition 400 serves as a mechanical mounting surface for all electrical and mechanical subassemblies of the disclosed invention. All subassemblies can be readily outfitted for other outer case shells 100 and 101 by customizing the center partition piece 400 for attachment to the new shell by way of screws 402 placed around the perimeter of piece 400 that are fashioned to drive into a mounting flange in the lower case shell 100. Two large openings 12 and 14 are cut in the center partition: one for a cash stronghold module 300 and one for a keypad 410, respectively.

The cash stronghold module 300 is covered by cash compartment door 301 which rotates open and closed on hinge 305. The door can be sealed closed with a latching mechanism, such as a pair of captured screws 302 that are capable of being hand-tightened and released. According to one aspect of the invention, at least one of the captured screws 302 has a fine thread requiring that a user undoing the screw rotate it multiple times to unscrew it. The beginning of rotation is detected. The time taken by the multiple rotations allows an alarm to sound or a notification to be made before the cash door 301 is opened.

Figure 4:
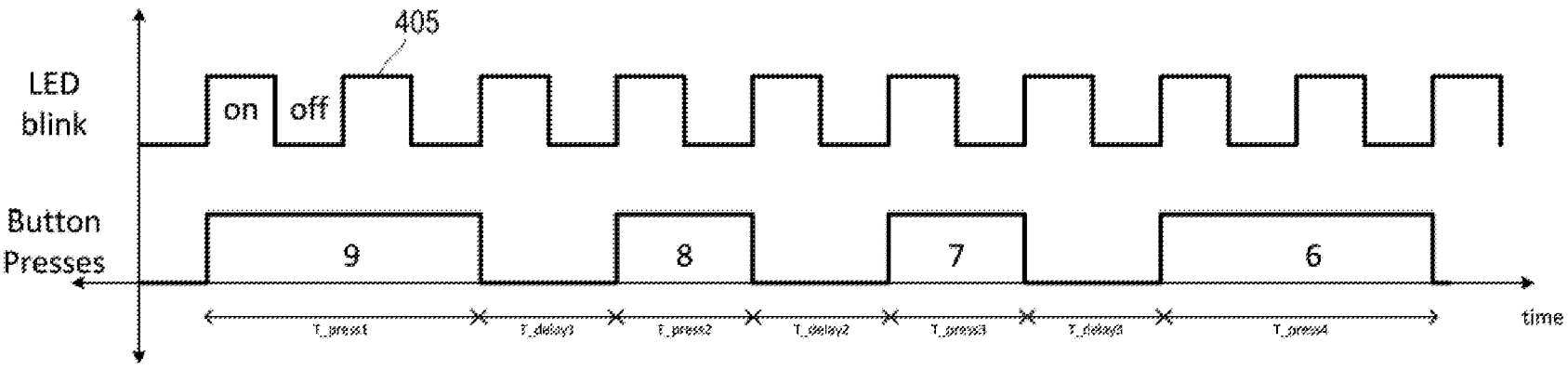
FIG. 4 illustrates a time sequence of button presses and, a corresponding timing reference of a blinking LED or LEDs to train a user in the sequence.
Figure 5:
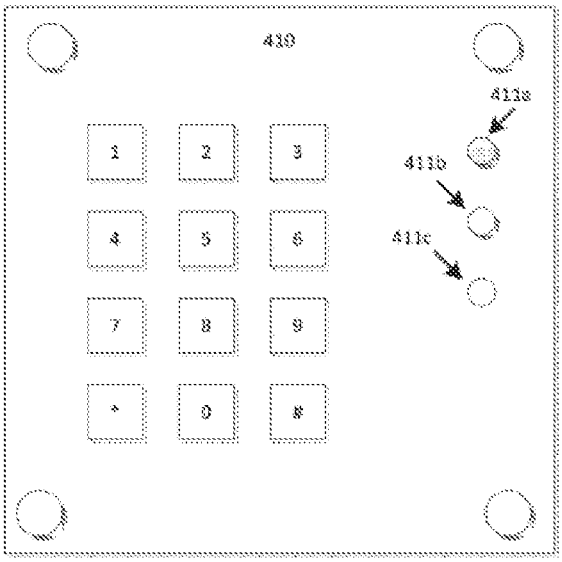
FIG. 5 shows a simplified keypad for use in conjunction with the invention.

FIG. 3 is a diagram illustrating further details of the keypad 410. The keypad 410 serves as a user interface to directly interface with the transport case in the event that the RF link is rendered ineffective. It can be used to place the case in an armed or disarmed state. LEDs 411 are provided on the keypad interface to provide visual guidance to the operator of successful or unsuccessful changes in case state. Additionally, a buzzer or other form of audible feedback may also be present. For an added layer of protection when using the keypad to disarm the case, it may be required that the operator enter in the correct pre-configured disarm code with each button press being asserted within a preconfigured window of time. Using the system's controller, intervals of time between button presses and durations of button presses can be measured and compared to a predetermined button press timing sequence as shown in FIG. 4. An algorithm programmed as a sequence of software steps can be employed by the controller to judge whether the button press sequence matches closely enough to the predetermined sequence before the case is allowed to disarm. The operator can be provided a timing reference by way of a blinking LED or a series of buzzer beeps, as illustrated by timing waveform 405 of FIG. 4. Such prompts help the operator consistently enter the PIN code at the proper time intervals such as through controlled flashes of one of the LEDs 411 in the keypad 410 of FIG. 5.

FIG. 4 shows an example of how the controller monitors the entered pin sequence for a four digit pin sequence: 9,8,7,6. The controller is advantageously configured to monitor both the timing of the delays between button presses: T_delay1, T_delay2, and T_delay3 illustrated in FIG. 4, and to monitor the time each button is held down, T_press1, T_press2, T_press3, T_press4. Of course, a simpler approach of monitoring one or the other may be employed if a lower level of security is acceptable and a simpler approach is desired. Each measured time duration is compared to the corresponding pre-programmed duration or recorded duration captured in a disarm code programming mode. If both the pin code and the duration sequences match within a certain tolerance, preferably a +/−50 ms window, the case can be disarmed.

The tolerance applied to each measured duration of time can be a pre-determined quantity or can be a function of how consistently the operator keyed in their PIN code during multiple trials in the training mode.

Figure 6:
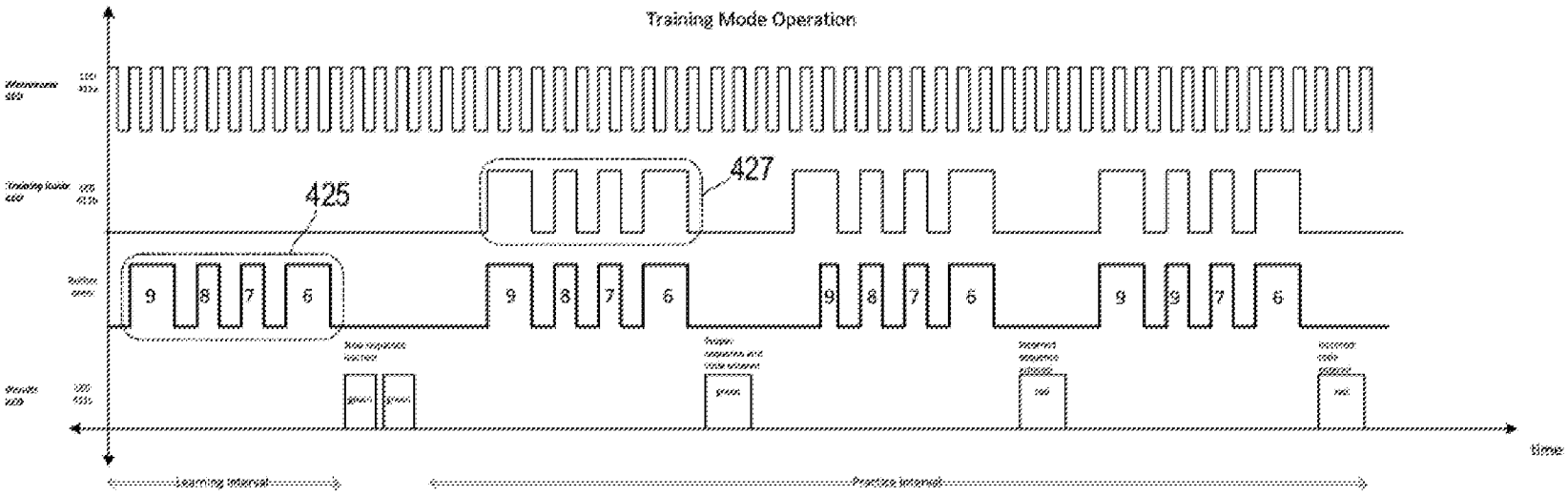
FIG. 6 illustrates aspects of training mode operation.

Additionally, a disarm code programming mode may suitably be employed in which the operator presses his or her code sequence at timing intervals of his or her choice and with button hold durations of his or her choice and the microcontroller captures and stores the sequence and timing information during a learning interval of the training mode operation as shown in the FIG. 6. The operator may enter the pin sequence 425 several times with the same timing intervals for the microcontroller to calculate average key press sequence timing information from which to generate thresholds for successful disarming. At the end of the learning interval, a bicolor result feedback LED 411*c* can be used to generate a learning complete indication such as a double green blink. If the user's key-press sequence was not entered consistently during the multiple averaged entries, the feedback LED 411*c* can be lit red to prompt the user to start over and try again.

As seen in FIG. 6, the training mode can also use an additional LED 411*b* or buzzer to indicate the preconfigured user sequence 427 as an aid for the user to practice the sequence with greater consistency during a practice interval. The duration of the practice interval can be a fixed amount of time or continue indefinitely until the training mode is exited by the user by a special key sequence or exit key button press. During the practice interval, the user must try to enter the pin key sequence coincidently with the guide LED 411*b* which is flashing with the same timing as their initial trained sequence programmed during the learning interval. In an alternate embodiment, the learning interval is eliminated and LED 411*b* flashes with a predetermined press sequence which may be randomly assigned and that the user must then learn during the practice interval. At the conclusion of each successful code entry during the practice interval, LED 411*c* will light a particular color, for instance, green, to indicate proper code entry. During each failed attempt, LED 411*c* will light a different color, for instance, red, to indicate improper code entry.

Another feature of the keypad 410 shown in FIG. 3, is to include a USB memory stick interface 414, to allow for updating the transport case controller firmware from a file from the USB memory stick, or exporting transport case information to a file utilizing the USB port. Transport case information may include configuration information, or a record of transactions and events. Alternatively, such information may be wirelessly transmitted to a remote location where it can be analyzed to determine busy and slow hours of operation, and the like, as well as, whether a cash pickup or drop-off needs to be made.

Another feature of the keypad 410 is to include security sensors such as a combined ambient light (ALS) and proximity sensor 412, and a temperature sensor 413. The ALS 412 can be used to detect a breach in the area of the transport case in front of the center partition that exposes the sensor surface to light above a predetermined threshold. The proximity sensor 412 detects motion of fingers or probe tools in the proximity of the keypad, but also is capable of detecting small motions in the outer case shell 101 which would occur if the case were to be pried or hinged open. The temperature sensor 413 can be used to detect the presence of extreme heat or cold which could be evidence of a tamper attempt in which a heat source such as a soldering iron or torch or a cold source like liquid nitrogen is applied in the vicinity of the keypad 410.

Figure 7:
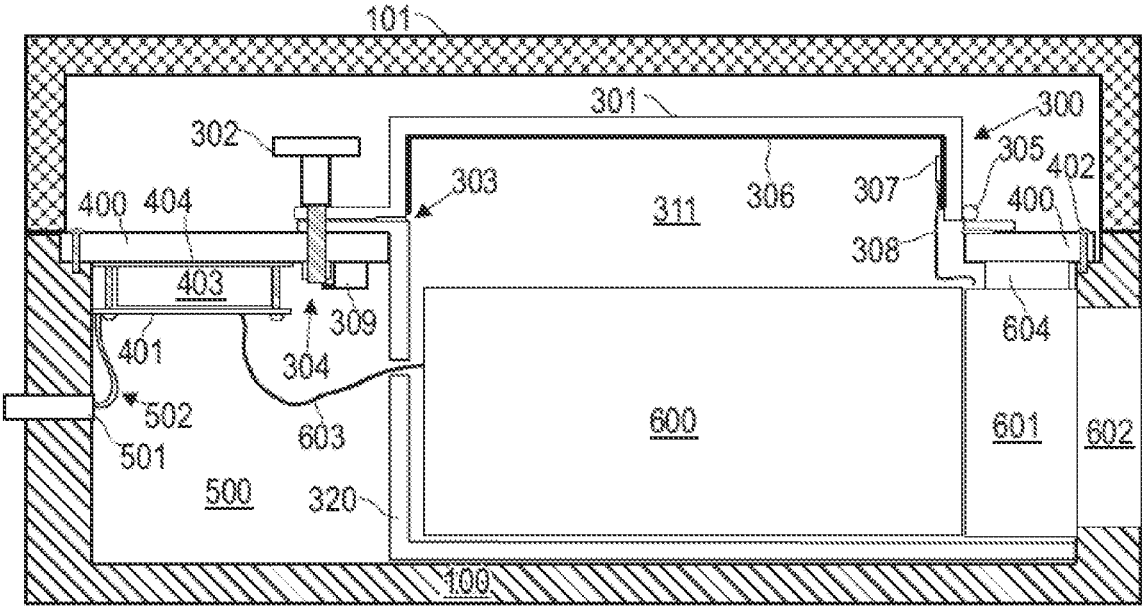
FIG. 7 illustrates cross-section of the transport case in accordance with an embodiment of the invention.

FIG. 7 shows a cross-sectioned view of portable cash transport apparatus 10 illustrating the area of the transport case behind the center partition 400. In this view, the main control board 401 can be seen. Control board 401 contains the controller, such as controller 1300 of FIG. 13, which may suitably be a programmed microcontroller, microprocessor, FPGA, ASIC, or the like, as mentioned above and additional security sensors. Controller 1300 controls a bill validator 601, which is preferably a combined bill validator and stacker unit, and alarm devices. The bill validator 601 is fastened to the center partition 400 with a bracket 604 and is installed such that the bill entry slot 602 is positioned through a rectangular opening in the outer shell of case 100. The validator is connected to the control board 401 utilizing a wire harness 603 so that the value of the cash stored within the validator's cash cassette 600 can be monitored by the controller and reported out over a communication link, such as link 1302.

Figure 9:
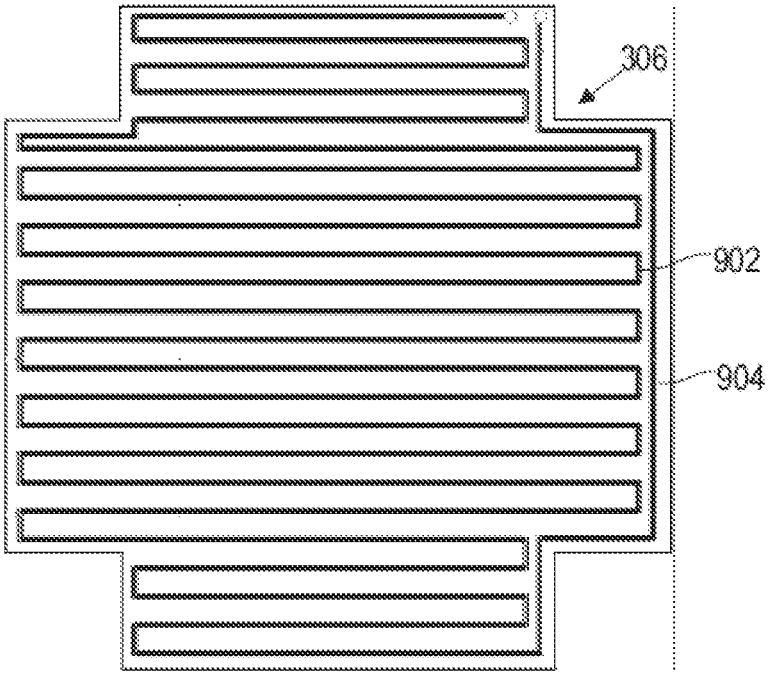
FIG. 9 illustrates a puncture membrane suitable for use in conjunction with the present invention.

FIG. 2 shows an exemplary configuration of tamper sensors 412 and 413 that protect the internal volume of the case in front of the center partition. The proximity and ALS circle detection window 429 is shown as a circular projection that extends above the keypad area 410. The temperature sensor 413 measures the temperature of a spot near the keypad. A puncture detection membrane 306 is fixed to the inner surface of the cash compartment lid 306. The puncture membrane 306 (further shown in FIG. 9) preferably consists of a zig-zag conductive element 902 patterned on a plastic, paper, or fiberglass substrate 904. If the zig-zag element 902 is broken at any point, the controller that monitors the normally low resistance of the element will detect an electrical open indicating an intrusion attempt. A second puncture membrane 404 of similar construction, is placed underneath the center partition between the partition wall and battery pack 403, as best seen in the cross-section of FIG. 7.

The cash compartment area is additionally monitored by a door sensor 309 which detects when the captured screw latches 302 are fully engaged. An ambient light sensor 307 is installed against the inner wall of the cash compartment door. A wire harness 308 runs from the ambient light sensor and puncture sensors through the cash compartment case wall and over to the control board 401, as seen in FIG. 7. A DC power input connector 501 passes through the outer shell of case 100, and carries electrical power over a wire harness 502 to the control board 401 where that power is used to recharge the battery pack 403 during charging or to directly power operation when the portable cash transport apparatus 10 is connected to power, as it is, for example, when engaged in docking station 700 of FIG. 12.

Figure 8:
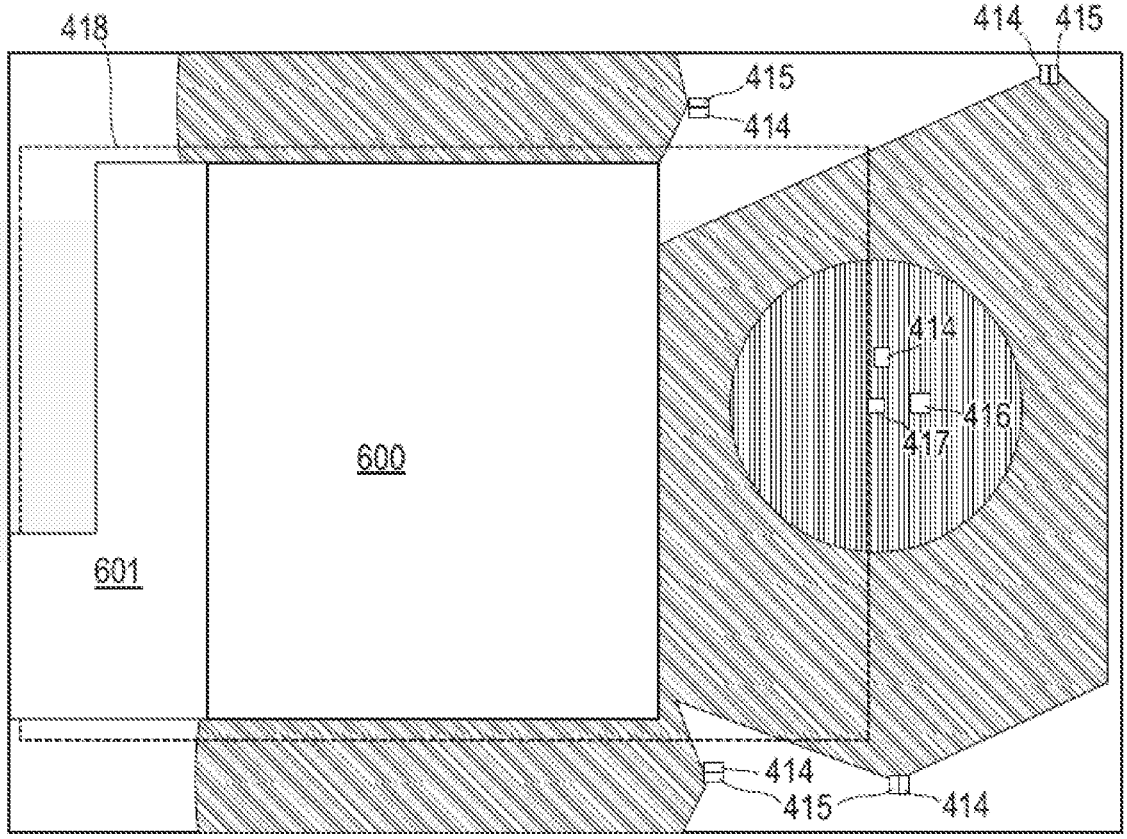
FIG. 8 illustrates an arrangement of proximity, ambient light, temperature and puncture sensors configured to detect tampering behind the center partition.

Behind the center partition, proximity, ambient light, temperature, and puncture sensors are configured to detect tampering preferably in an arrangement shown in FIG. 8. Multiple ambient light sensors 415 are oriented to be side-firing such that their detection angle extends parallel to the surface of the center partition. The zones of light detection are shown cross-hatched in FIG. 8. Temperature sensors 414 are placed near each of the ambient light sensors to monitor for extreme temperatures at those locations. Additionally, a temperature sensor is located on the control board, as well as, a proximity sensor 417 and an accelerometer 416. The proximity sensor on the control board 401 functions in a similar manner as the one mounted on the keypad 410, in that it detects motion of objects nearby as well as any motion of the outer case shell 100 with respect to the control board 410. To further detect tampering of cash stronghold module 320 (FIG. 7), a puncture sensor 418 is wrapped around the subassemblies and wired into the control board 401 for monitoring.

All sensors located remotely from the control board are preferably configured with serial communication links such as I2C, and are individually addressed so they can be wired along a common harness back to the control board. Furthermore, the idle state of the electrical signals on the wires that comprise the harness can be monitored by the control board to determine if the harness is cut. For instance, the idle state on each wire of the I2C serial link may be 3.3V as the result of a pull up resistor to a 3.3V supply rail located at the most remote sensor in the daisy chain link of sensors. If the link is cut, the I2C lines in their idle state would register 0V at the controller.

Figure 10:
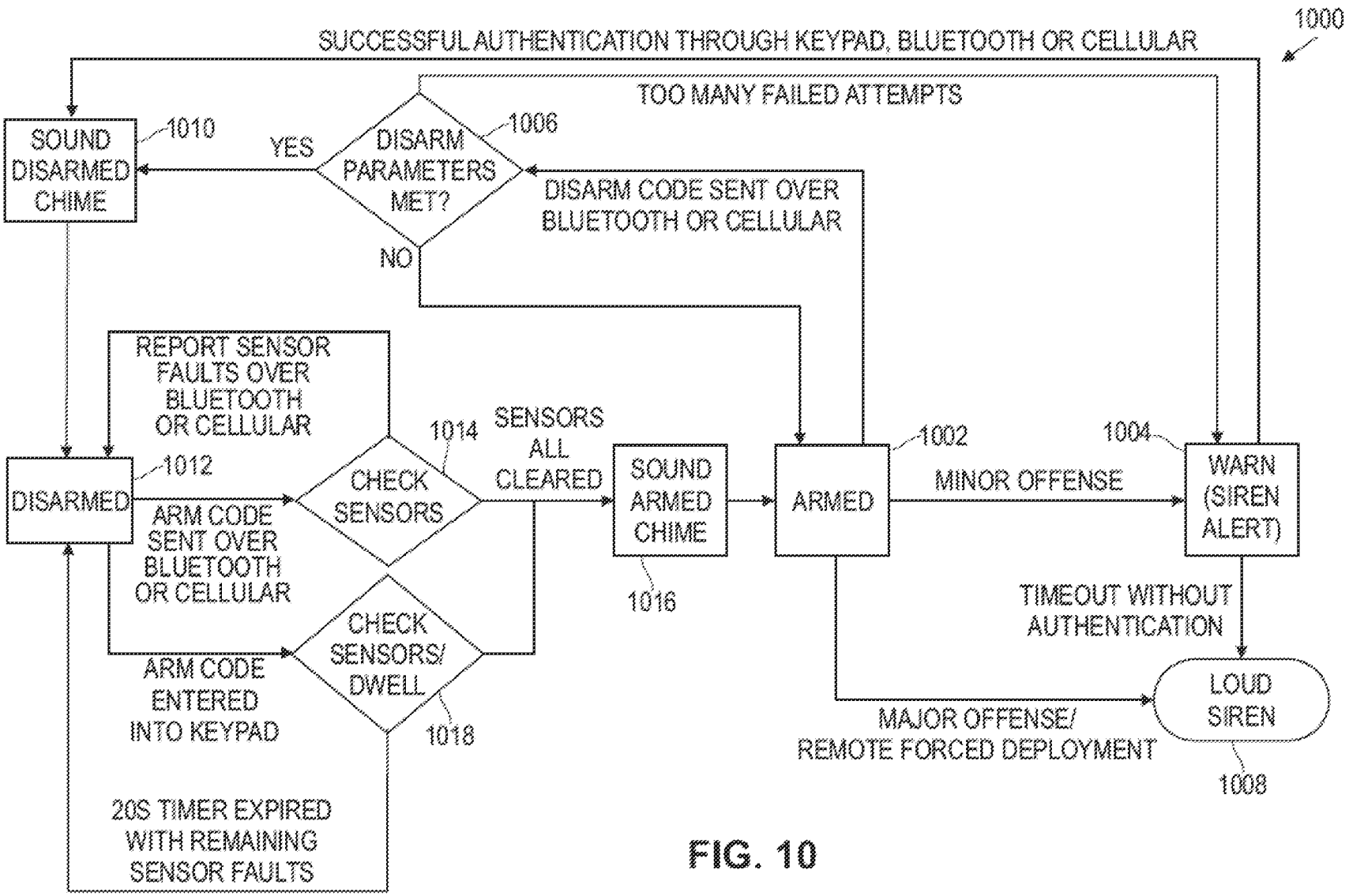
FIG. 10 illustrates a state machine illustrative of operation of the microcontroller of one embodiment of the transport case of the present invention.

Depending on the state of the transport case in addition to which tamper sensor has triggered, the controller will respond differently as shown in the FIG. 10 state machine 1000. When in the armed state 1002, tamper sensor activity can be classified as either a minor offense or a major offense. Minor offenses may include opening the outer case without first disarming it through an RF means, such as with a Bluetooth® or cellular link, or utilizing the keypad. This opening would be detected as triggering the ambient light and proximity sensors located in front of the center partition. Minor offenses may also include small periodic vibrations or small impacts detected by the accelerometer. Major offenses would be the detection of any extreme temperatures at the monitored locations around the case, any detected puncture events, or any motion or light detected behind the center partition or within the cash box. Additionally, opening the cash compartment door, as indicated by detecting activation of the door sensor, before disarming would also classify as a major offense.

Minor offenses result in the transport case entering a warn state 1004 in which an audible alert is given by activating an audio source or annunciator, such as a beeper, a buzzer or the like. Once in the warn state, the operator must successfully disarm the case within a predetermined period of time as detected in disarm parameters met state 1006 or the case 10 will activate a loud siren and/or send out wireless notifications. A major offense results in the immediate activation of the siren in loud siren state 1008. Upon proper disarming of the case, audible feedback, as in sound disarmed chime state 1010, may be given to indicate the operator may proceed to open the case and access the cash stronghold module, and the case 10 proceeds to enter the disarmed state 1012. Security parameters may be configurable to only allow for disarming during certain times of day or when the case is located at predetermined locations verifiable by electronic means such as wireless beacons or global positioning services.

From the disarmed state 1012, a user may arm the case by entering the arm code on the keypad or it can be sent over Bluetooth® or a cellular phone connection. Sensors are checked in state 1014. If the sensors are all clear, sound armed chime state 1016 is entered and then followed by armed state 1002. If in check sensors dwell state 1018, the sensors were not all clear, for example, by a 20 s timer expiring with remaining detected sensor faults, the process returns to the disarmed state 1012.

Figure 11:
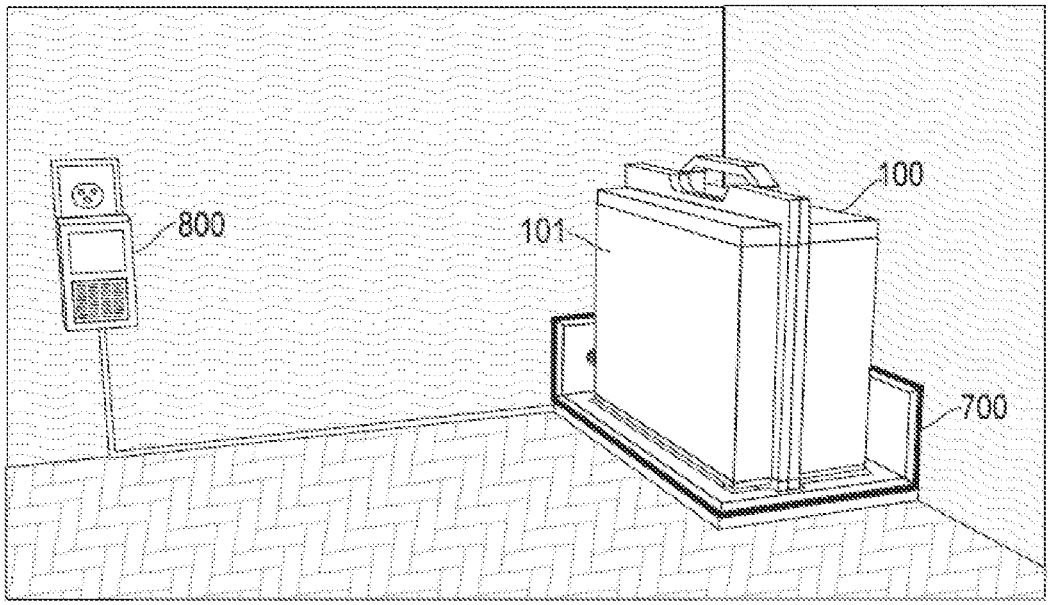
FIG. 11 illustrates a docking station arrangement in accordance with one embodiment of the invention.

While at the point of sale, the transport case 10 can be further secured in place with the use of a permanently installed docking station 700 as shown in FIG. 11. The docking station 700 can be configured to bolt to the floor, walls, or both. The station may also provide a recharging station to recharge the transport case batteries with the aid of an AC to DC power supply 800. Power supply 800 also provides power for docking station locking solenoids 702 seen in FIG. 12.

Figure 12:
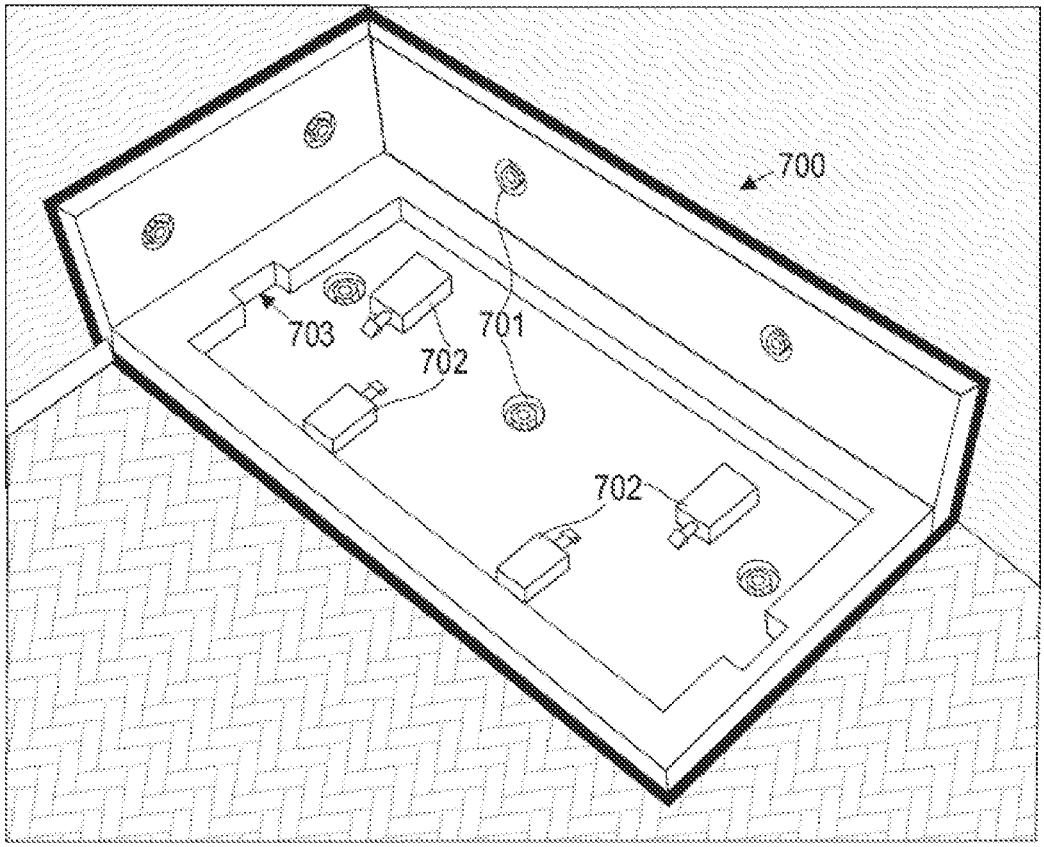
FIG. 12 illustrates further details of the docking station of FIG. 11.

In FIG. 12, a close-up view of the docking station 700 is shown with exemplary bolt locations 701, locating features 703 for properly insuring correct alignment of the transport case base with docking station 700, and a series of four locking solenoids 702, that are configured to latch on to mating features at the base of the transport case. The docking solenoids can be configured to release the case at a particular time of day or on programmed schedule. Alternatively, the docking station may be controlled to release the case upon detecting the presence of an electronic pass key in the form of a unique RF signal (such as Bluetooth®, RFID tag), mechanical key, or Dallas key. In place of solenoids 702, it will be recognized that other mechanical locking mechanisms may be used to secure the transport case in place while at the point of sale location. Further, while plural solenoids 702 are illustrated to save costs, as few as one solenoid may be suitably employed. While not shown, a mating charging connector is preferably employed to provide power through a connector, such as connector 501 of FIG. 7, for example.

Figure 13:
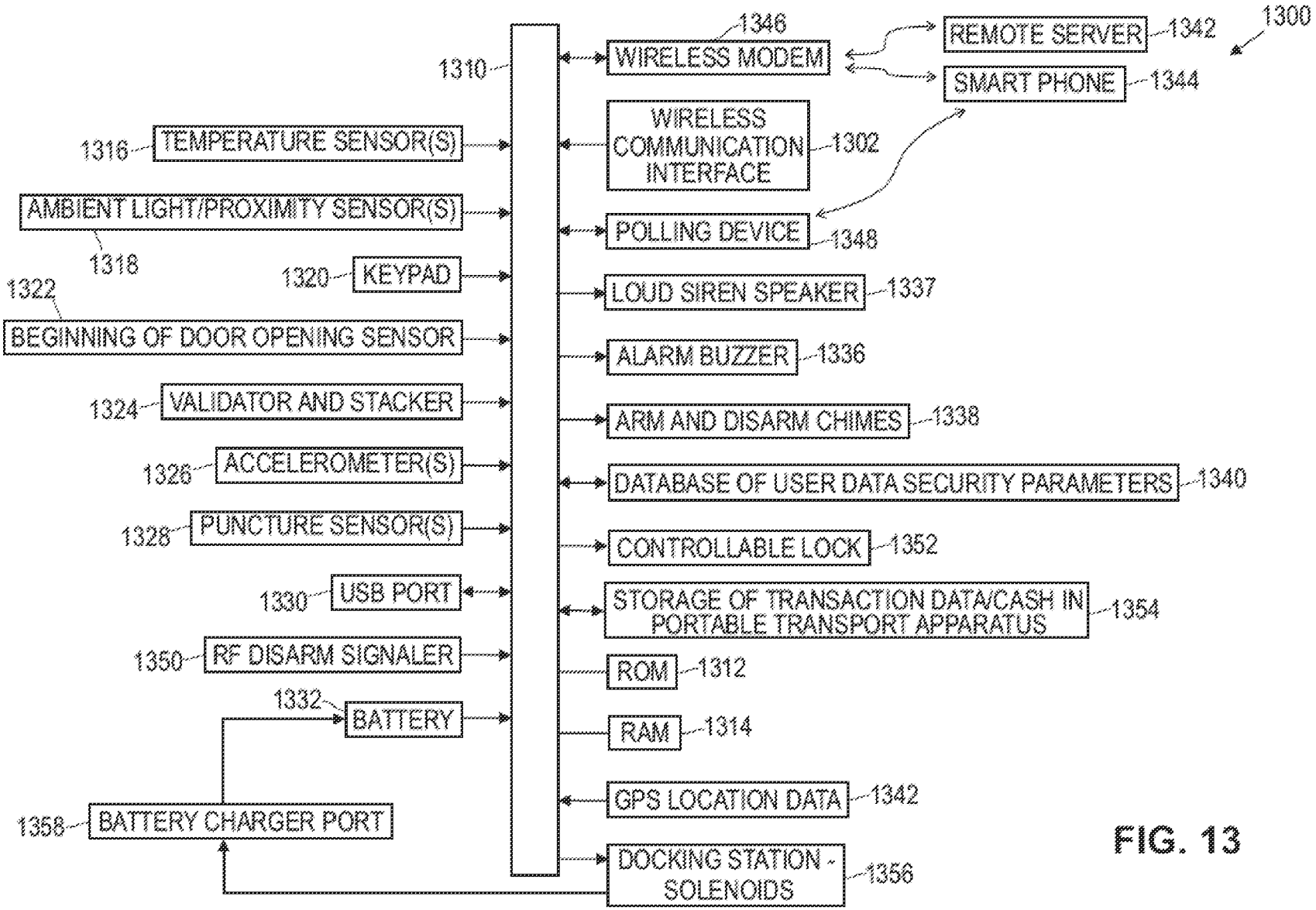
FIG. 13 is a block diagram of an exemplary control system for a transport case in accordance with the present invention.

FIG. 13 shows an exemplary control system 1300 for the portable cash transport apparatus 10 including a programmed microprocessor 1310. As seen in FIG. 13, system 1300 includes memory, such as RAM 1312 and ROM 1314. Microprocessor 1310 receives a variety of inputs such as temperature data from a temperature sensor 1316, ambient light sensor (ALS) and proximity sensor 1318, keypad 1320, beginning of door opening sensor 1322, validator and stacker 1324, an accelerometer or accelerometers 1326 for motion detection, puncture sensors 1328, a universal serial bus 1330, as well as, power from a battery 1332.

Microprocessor 1310 also provides driver signals to user prompt LEDs and a buzzer 1334, drives a loud siren speaker 1337, an audible alarm, such as alarm buzzer 1336, and arm and disarm chimes 1338. The microprocessor 1310 also stores and retrieves data from a database 1340 of user data and security parameters. For example, database 1340 may suitably store user names along with their access codes and permission levels. The database 1340 may also store global positioning satellite (GPS) coordinates of valid destination waypoints, and identification numbers of wireless radio keypads, user smart devices or waypoint beacons.

By way of example, the portable cash transport apparatus 10 may be employed in a food truck which from 10 pm until 6 am is expected to be parked at a first location. From 6 am-6:30 am, it is expected to be in transit from the first parking location to a second parking location where breakfast items are sold from 6:30 am-10:30 am. The food truck then travels to a third resupply location and then goes to a fourth location where lunch items are sold from 11:00 am until 2:30 pm. The truck then again resupplies and goes to a fifth location where dinner items are sold from 4:30 pm until 10 pm. After 10 pm, the portable cash transport apparatus 10 is taken to a location where cash is removed.

As another example, the portable cash transport apparatus 10 may be employed to collect cash from kiosks or retailers at a mall, or from concessions at a ballgame, or the like.

Again, the location can be tracked and matched against an expected route as an operator collects cash which is validated and stored. A transaction receipt can be texted or otherwise provided to each kiosk operator, retailer or the like if desired.

Controller 1310 can receive GPS data 1342 and compare data stored in database 1340. If the two do not match up appropriately, an alarm can be sounded using loud siren speaker 1336 and a supervisor or other authorized personnel can be notified by sending an alert to a remote server 1342, a smart phone 1344, or the like.

Microprocessor 1310 also may suitably communicate to a remote computer utilizing a modem or wireless modem 1346. A polling device 1348 in the portable case 10 can poll a user and then communicate with microprocessor 1310. If the user does not respond to a polling attempt within a predetermined acceptable time to reply, the polling device 1348 informs microprocessor 1310 which then drives loud siren speaker 1336 to sound a loud audible alarm and to communicate the failure to authenticate to a supervisor through wireless communication interface 1302, wireless modem 1346, or the like.

When a disarm signal is received from an RF disarm signal unit 1350 or the correct sequence of keystrokes is received from keypad 1320, the microprocessor 1310 disarms the portable case 10 allowing an operator to access cash storage. In a presently preferred embodiment, the portable cash transport apparatus 10 is light and its plastic case is relatively easy to drill into or otherwise attack by a vandal or thief. Security is primarily provided by detecting such attacks, activating an alarm, and reporting the attack. However, it will be recognized a sturdier case may be employed utilizing a controllable lock 1352 to lock and unlock the case. Additionally, the ink deployment device of U.S. Pat. No. 9,406,208, filed Jun. 12, 2014, and incorporated by reference herein can also be employed to deter attempted thefts by rendering any internal access unavailing by deploying ink before someone intent on theft can access any stored cash.

Similarly, the portable case 10 can be armed employing an RF arm signal unit 1351. As cash is deposited, sales are made and the like, storage transaction data, such as the current amount of cash in the portable transport apparatus 10 is stored in storage 1354. Such data can be subsequently retrieved and analyzed to provide useful information about times when sales are most frequent, and the like.

In a presently preferred embodiment, when the portable transport apparatus 10 is inserted in a docking station 1356, the microprocessor 1310 provides control signals causing solenoids in docking station 1356 to lock the portable transport apparatus 10 in place. Power is supplied by the docking station 1356 through a connector (not shown) to a battery charging port 1332, such as connector 501 of FIG. 7. While connector 501 is shown in a side of the portable case 10, it will be recognized it can be in the bottom as well.

It will be clear that there are numerous configurations and embodiments possible using the technology and techniques described above. While the present invention is disclosed in the context of presently preferred embodiments, it will be recognized that a wide variety of implementations may be employed by persons of ordinary skill in the art consistent with the above discussion and the claims which follow below.

We claim:

1. A hand carried portable valuables transport system comprising:

an outer closeable portable container having a handle utilized to hand carry said portable valuables transport system;

an inner valuables container inside the outer closeable portable container;

a tamper mechanism for detecting tampering with the outer closeable portable container and the inner valuables container;

the outer closeable portable container enclosing the tamper mechanism; and a battery powered controller mounted inside the outer closeable portable container controlling the tamper mechanism and monitoring tampering of both the outer closable portable container and the inner valuables container, the tamper mechanism operating using battery power when the portable valuables transport system is not connected to another source of power;

wherein the inner valuables container, the tamper mechanism and the battery powered controller are fixedly mounted to a mechanical mounting surface of the outer closable portable container; and wherein the tamper mechanism and the battery powered controller are each coupled to a control board also mounted to the mechanical mounting surface of the outer closable portable container.

2. The portable valuables transport system of claim 1, further comprising:

an arm and disarm mechanism located inside the outer closeable portable container.

3. The portable valuables transport system of claim 2, in which one way to access the inner valuables container comprises opening the outer closeable portable container and then disarming the arm and disarm mechanism within a predetermined period of time after opening the outer closeable portable container.

4. A hand carried portable valuables transport system comprising:

an outer closeable portable container;

an inner valuables container inside the outer closeable portable container;

a tamper mechanism for detecting tampering with the outer closeable portable container and the inner valuables container;

the outer closeable portable container enclosing the tamper mechanism;

a battery powered controller mounted inside the outer closeable portable container controlling the tamper mechanism, the tamper mechanism operating using battery power when the portable valuables transport system is not connected to another source of power;

a currency validator; and a battery adequate to supply power for mobile operation of the currency validator if the outer closeable portable container is disconnected from a mounting dock and not connected to another source of power.

5. The portable valuables transport system of claim 4, further comprising:

a communication interface controlled by the controller to communicate a total amount of cash in the portable valuables transport system to a remote location.

6. A hand carried portable valuables transport system comprising:

an outer closeable portable container;

an inner valuables container inside the outer closeable portable container;

a tamper mechanism for detecting tampering with the outer closeable portable container and the inner valuables container;

the outer closeable portable container enclosing the tamper mechanism; and a battery powered controller mounted inside the outer closeable portable container controlling the tamper mechanism, the tamper mechanism operating using battery power when the portable valuables transport system is not connected to another source of power;

an arm and disarm mechanism located inside the outer closeable portable container; and an alarm and wherein if the inner valuables container is opened without disarming the arm and disarm mechanism, the alarm is actuated.

7. The portable valuables transport system of claim 6, further comprising:

a mounting dock; and a mounting mechanism to mount the outer closeable container in the mounting dock.

8. The portable valuables transport system of claim 6, further comprising:

an internal polling mechanism to poll a user to provide a response, wherein if the response is not received in a predetermined time, the alarm is sounded.

9. The portable valuables transport system of claim 6, wherein the tamper mechanism further comprises:

light sensors and infrared proximity sensors to detect tampering with the inner valuables container.

10. The portable valuables transport system of claim 6, wherein the arm and disarm mechanism comprises:

a keypad internal to the outer closeable portable container configured to arm and disarm the alarm, the keypad requiring a correct key press sequence and proper delays between key presses.

11. The portable valuables transport system of claim 6, wherein when the outer closeable portable container is closed, an internal cavity is defined having an illumination below a predetermined low level, and wherein:

the tamper mechanism comprises a sensor to detect possible tampering by detecting an increase in illumination above the predetermined level; and the battery operated controller operates to determine the increase in illumination has occurred during a period when the arm and disarm mechanism to arm and disarm the alarm has not been disarmed.

12. The portable valuables transport system of claim 6, further comprising:

reflective infrared (IR) proximity sensors to sense motion of a wall of the outer closeable portable container or a tool inserted through a wall of the outer closeable portable container.

13. The portable valuables transport system of claim 6, further comprising:

a communication link to communicate a notification that the alarm has occurred.

14. The portable valuables transport system of claim 7, wherein the mounting dock further comprises a mechanism to recharge the battery.

15. The portable valuables transport system of claim 6, further comprising:

a polling mechanism to poll a mobile phone of an authorized user of the portable valuables transport system at periodic or random intervals.

16. The portable valuables transport system of claim 6, further comprising:

a vibration detector to detect impacts on an outer surface of the outer closeable portable container.

17. The portable valuables transport system of claim 16, wherein the arm and disarm mechanism is disarmed in response to detection of a predetermined sequence of taps on the outer surface of the outer closeable portable container by the vibration detector.

18. The portable valuables transport system of claim 6, further comprising:

a database internal to the outer closeable portable container storing all necessary user data and security parameters.

19. The portable valuables transport system of claim 6, wherein valuables pass through an opening for insertion of valuables into the outer closeable portable container and are stored inside the inner valuables container.

* * * * *